United States Patent [19]

Bellati et al.

[11] 3,980,357

[45] Sept. 14, 1976

[54] INTERNAL OIL CONNECTION ASSEMBLY HAVING MODULAR INSERTS FOR ROTARY MACHINE BEARING BLOCKS

[75] Inventors: Hans Bellati, Wettingen, Switzerland; Oscar Beuttenmüller, Dogern, Germany; Hans Huber, Oberrohrdorf, Switzerland

[73] Assignee: BBC Brown Boveri & Company Limited, Baden, Switzerland

[22] Filed: July 2, 1975

[21] Appl. No.: 592,472

[30] Foreign Application Priority Data

July 31, 1974 Switzerland ..... 10558/74

[52] U.S. Cl. ..... 308/78; 184/6.4; 184/6.21

[51] Int. Cl.[2] ..... F16C 1/24

[58] Field of Search ..... 184/6.4, 6.21, 6.24, 184/7 F; 308/78

[56] References Cited

UNITED STATES PATENTS

| | | | |
|---|---|---|---|
| 2,239,447 | 4/1941 | Ryder | 184/6.21 |
| 2,422,498 | 6/1947 | Perlman | 184/6.4 |
| 2,502,318 | 3/1950 | Fischer | 184/6.4 |
| 2,706,905 | 4/1955 | Wilson | 184/6.4 |
| 2,801,006 | 7/1957 | Haltgren et al. | 184/6.24 |
| 3,223,198 | 12/1965 | Gruber | 184/6.4 |
| 3,504,769 | 4/1970 | Mettig | 184/6.24 |
| 3,665,684 | 5/1972 | White | 184/6.21 |
| 3,741,342 | 6/1973 | Maddalozzo | 184/6.4 |

*Primary Examiner*—M. H. Wood, Jr.
*Assistant Examiner*—Gene A. Church
*Attorney, Agent, or Firm*—Toren, McGeady & Stanger

[57] ABSTRACT

An internal oil connection assembly for use with the bearing blocks of rotating machines is provided with a connector housing adapted to cooperate with replaceable modular inserts. Connections for oil inlet measuring means, oil outlet means and removable oil diaphragm means are provided and modular inserts including an insert for scavenging the oil assembly may be replaceably connected to the housing.

6 Claims, 3 Drawing Figures

INTERNAL OIL CONNECTION ASSEMBLY HAVING MODULAR INSERTS FOR ROTARY MACHINE BEARING BLOCKS

BACKGROUND OF THE INVENTION

The present invention relates generally to internal oil connection means utilized on the bearing blocks of rotating machines. More specifically, the invention relates to an assembly involving the use of lubricating and oil scavenging elements.

In the provision of lubricant supply devices for the bearings of rotating machines, particularly turbine bearings, it has heretofore been customary to arrange a double-walled lubricant feed pipe by means of a flanged connection on the outer side of a bearing block in the central region thereof. By this arrangement, there may be provided a removable oil diaphragm element between the flanged connection and the wall of the bearing block. An oil discharge pipe is likewise attached to the outer side of the bearing block in the lower region thereof by utilization of flanged connector means.

The type of structure utilized heretofore involving the principles mentioned above usually requires relatively complicated lines including the assembly of up to three separate oil lines, corresponding to the type of bearing block involved, with outer flange connections which are subject to leakage and which give rise to a serious fire hazard when leakage through the connections is in danger of occurring. The replacement of oil diaphragms in such assemblies almost always results in oil losses and thus in contamination of the entire lubricating system.

The present invention is directed toward providing an internal oil connection assembly for the bearing blocks of a rotating machine wherein flanged connections, a removable oil diaphragm, an oil scavenging insert and all of the measuring elements of the unit may be combined in a single element with this element being mounted within the bearing block or within a generator shield so that they may be contained in a pressurefree environment.

SUMMARY OF THE INVENTION

Briefly, the present invention may be described as an internal oil connector assembly for the bearing block of a rotating machine comprising a connector housing having replaceable modular inserts positionable therein and including connections for oil inlet measuring means, oil outlet means, and removable oil diaphragm means replaceably arranged in said bearing block.

The present invention provides a solution to the problems discussed above in that a housing having connections for an oil inlet, measuring elements, oil outlet and a removable oil diaphragm enables these elements to be arranged replaceably in the region of the bearing block.

An advantage of the present invention particularly involves the fact that the escape of leakage oil is prevented by the housing being provided with all of the oil connections, with the housing being mounted in a flanged arrangement inside the bearing block. Thus, any leak which may occur in the oil supply line will not necessarily result in loss of any oil inasmuch as the supply line may be arranged within the discharge duct of the housing. Replacement of the oil diaphragm, which may become necessary as a result of variations in the oil pressure, presents no practical difficulty inasmuch as the oil diaphragm is arranged as a part of the overall connector housing assembly inside of the bearing block housing and disassembly of the supply and discharge lines of the lubricating oil system is thus no longer necessary.

In accordance with a further aspect of the internal oil connection assembly of the present invention, a removable scavenging insert having a short circuit oil line to the oil discharge is arranged within the housing in order to enable scavenging of the oil lines. Connections for scavenging lines which are connected to the short circuit oil line are provided on the removable scavenging insert for enabling scavenging of the inner surface of the bearing block.

The arrangement of the removable scavenging insert, which involves both a short circuit oil line and connections for scavenging lines, permits the insertion of corresponding inserts in a simple manner within the internal oil connector housing in order to scavenge both the oil lines and the inner surface of the bearing block after the assembly of the bearings and the oil lines without requiring special assembly operations in performing the necessary connections.

A further advantage of the present invention arises in that, due to the symmetrical casting structure of the bearing block, it becomes possible to concentrate all of the control and measuring implements for monitoring the discharge of the lubricating oil on the opposite side. The instruments for monitoring the oil supply are arranged directly upon the internal oil connector housing. This arrangement insures the provision of a functional and simple control and monitoring arrangement for the lubricating oil flow and for the pressure of the lubricating oil.

In accordance with a further aspect of the invention, the connections for the scavenging lines are arranged to open into the oil carrying pressure line and a plug or filter is provided on the latter for the performance of the scavenging operation.

The design of the present invention permits testing of the oil supply lines without additional assembly operations by simultaneously closing the oil outlet and the oil inlet thus allowing them to be tested for tightness.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE PREFERRED EMBODIMENTS

Figure 1:
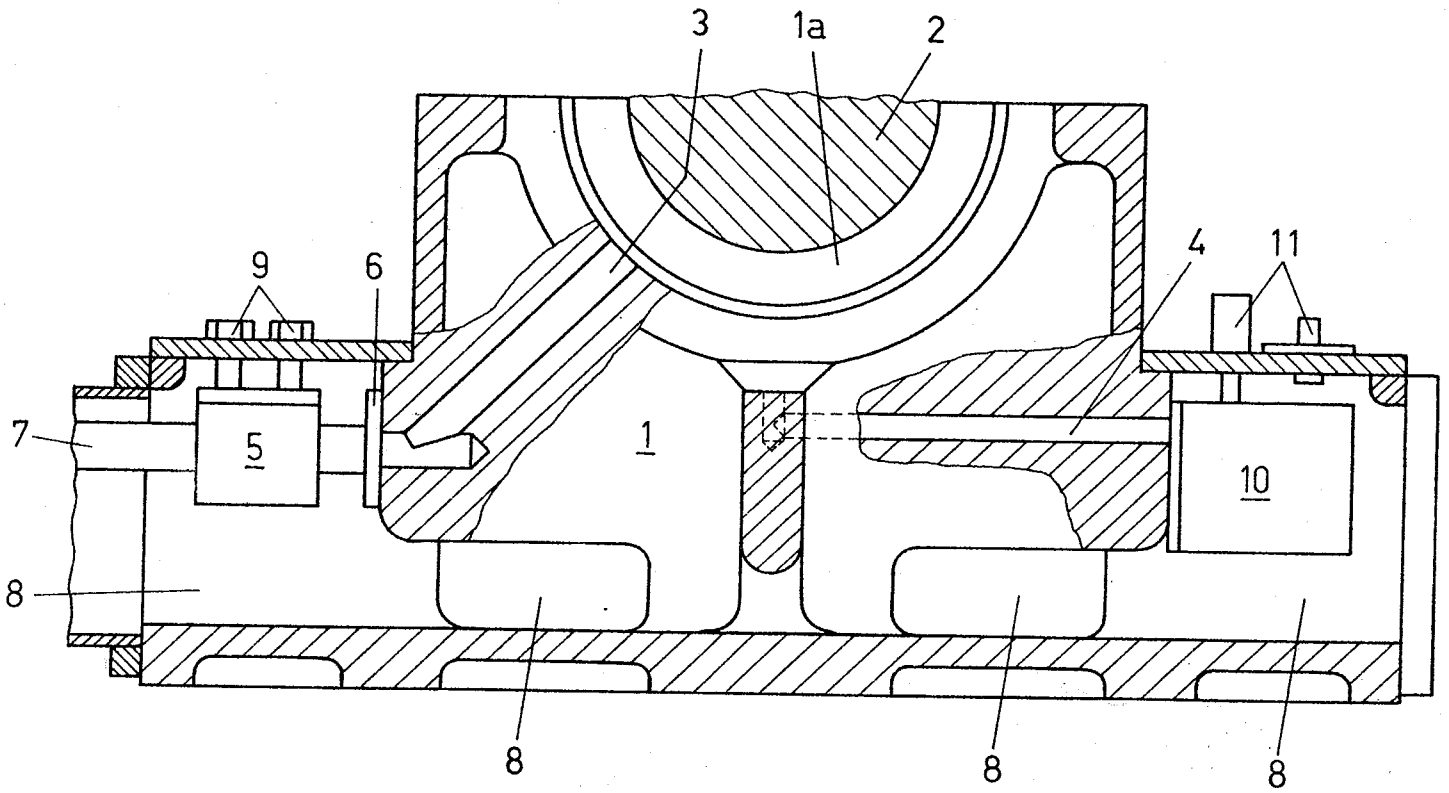
FIG. 1 is a cross-sectional view of a bearing block arrangement showing the internal oil connection assembly of the invention.

Referring now to FIG. 1 the device of the present invention is shown mounted within an overall structure which includes a bearing block 1 having mounted therein a bearing shell or pad 1*a* for a rotating shaft 2 of a rotating machine such as a turbine. Arranged within the bearing block 1 is an oil supply duct 3 which leads to the bearings of the machine with an oil duct 4 leading away from the bearings. The oil supply duct 3 leads to an internal oil connector housing 5 with which it is connected by means of a flange connection 6.

An oil supply pressure line 7 communicates the internal oil connector housing 5 with an oil supply system (not shown).

The internal oil connector housing 5 is installed in the oil supply pressure line 7 within a duct 8 of the bearing block 1 which serves as an oil discharge line. The duct 8 extends over the entire width of the bearing block 1.

On the upper side of the connector housing 5 there are arranged pressure measuring connections 9. The oil duct 4 opens into an oil discharge monitoring element 10 with connections 11 being provided for remote control and direct reading of temperature.

Figure 2:
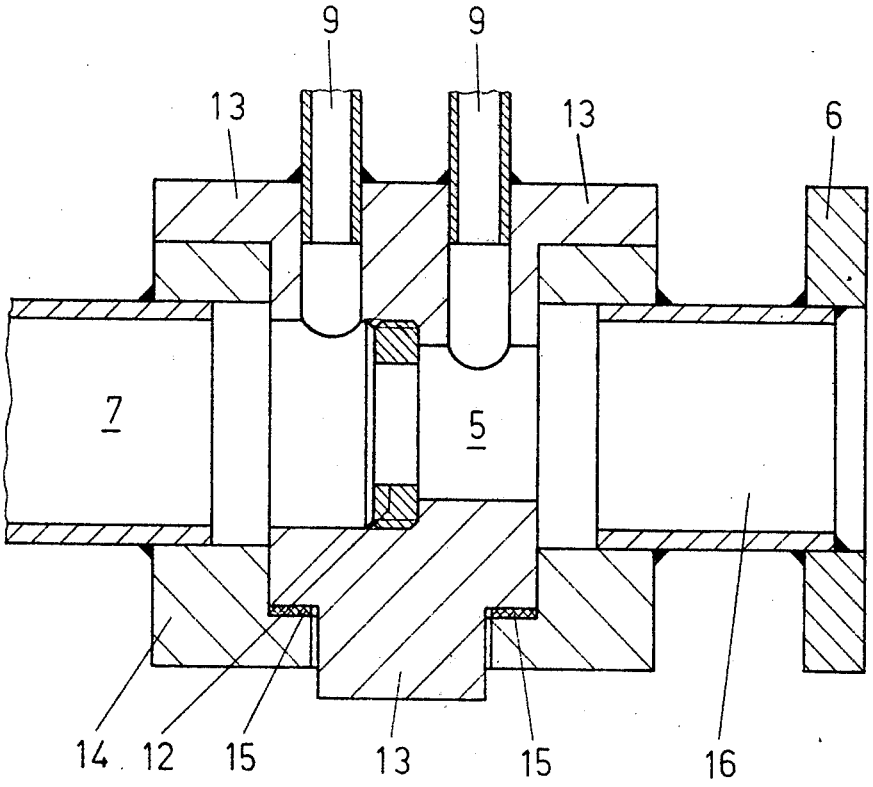
FIG. 2 is a cross-sectional view showing the internal oil connection assembly in greater detail.

In FIG. 2 there is shown a longitudinal sectional view taken through the internal oil connector housing 5 showing the oil supply pressure line 7 with a pair of pressure measuring connections 9 being depicted. One of the pressure measuring connections 9 is arranged in front of an oil diaphragm which defines an orifice 12 which is provided in the oil supply pressure line 7. The second pressure measuring connection 9 is arranged in the direction of flow behind the oil orifice 12. Both the pressure measuring connections 9 and the oil orifice 12 are formed as part of a removable modular insert 13 which is mounted in a bush 14 by means of sealing elements 15. Between the oil orifice 12 and the flange 6 there is provided an oil outlet duct 16 which opens into the oil supply duct 3.

Figure 3:
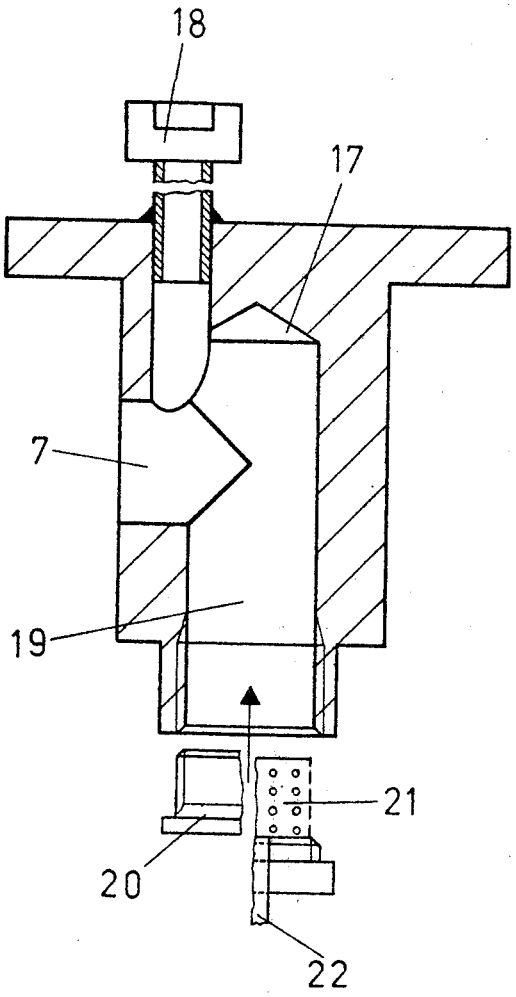
FIG. 3 is a cross-sectional view depicting the removable scavenging insert of the present invention.

In FIG. 3 there is depicted a further aspect of the present invention which involves utilization of a removable scavenging insert 17, which may be utilized for scavenging the oil supply and oil return lines of the bearing block. The insert 17 is inserted into the internal oil connector housing 5 in place of the removable insert 13 which is used during a normal operation of the device.

The removable scavenging insert 17 has scavenging line connections 18 which open directly into the oil supply pressure line 7. Furthermore, the insert 17 includes a short circuit oil line 19. In order to provide for scavenging of the oil lines, a filter 21 with a discharge pipe 22 opening into the line 8 is connected upon the short circuit oil line 19. For scavenging the inner surface of the bearing block, a plug 20 is inserted into the short circuit oil line 19.

In the operation of the arrangement described above, the shaft 2 of the rotating machine, which may be a turbine, is mounted in the bearing block 1 which is designed as a casting with the bearing shell 1a being provided for the machine. At the same time, the oil supply duct 3 and the oil duct 4 are arranged to lead to and from the bearing. On the oil supply duct 3, the internal oil connector housing 5 is mounted by means of the flange 6 in the oil supply pressure line 7. On the oil discharge side, the oil duct 4 opens into the oil discharge monitoring element 10 with the connections 11 for the remote control and direct reading of temperatures.

In the normal operating condition of the rotating machine, the internal oil connector 5 is arranged so that the removable insert 13 is inserted into the housing 5 with the two pressure measuring connections 9. The insert 13 is arranged in the bush 14 and connected by means of sealing means 15. Between the two pressure measuring connections 9 there is arranged the removable oil orifice 12 which permits the unit to be adapted to the necessary oil pressure in accordance with the requirements of the machine. Since the oil orifice 12 is arranged between the two pressure measuring connections 9, with one of the connections 9 being forwardly of the orifice 12 and the other being behind the diaphragm 12, it is possible to measure both the pressure of the oil introduced from the oil supply pressure line 7 and the pressure within the oil duct 16 leading to the oil supply duct 3.

After the pipe lines have been assembled upon the rotating machine, all of the ducts and lines may be tested both for their compressive strength and tightness by using the removable scavenging insert 17 which may be placed within the internal oil connector housing 5. The operation of the insert 17 may be utilized, as well, in order to flush out any residual materials such as boring and grinding chips from the lines and from the inner surface of the bearing block without covering the bearing block 1 and disassembling the bearing shell 1a. To this end, the removable scavenging insert 17 is inserted into the internal oil connector housing 5 in place of the insert 13. The removable scavenging insert 17 has on its top side scavenging line connections 18 which are attached to the oil supply pressure line 7 and the short circuit oil line 19. The short circuit oil line 19 may be closed by a plug 20 in the case where the oil lines are to be tested. When the oil lines and the inner surface of the bearing block are to be scavenged, the filter 21 with the outlet pipe 22 is inserted into the short circuit line 19 in place of the plug 20.

After the scavenging operation is completed, a determination can be made based upon the residues remaining in the filter 21 as to whether the oil lines are completely clean or whether further scavenging may be necessary.

Due to the symmetrical configuration of the casting comprising the bearing block 1, it is possible to concentrate all of the control and measuring instruments for monitoring the lubricating oil discharge on the side opposite the oil supply side. Furthermore, it is readily possible, without special or expensive constructional measures, to arrange the instruments for monitoring the oil discharge in a simple manner upon the pressure measuring connections 9 of the internal oil connector housing 5.

Due to the exchangeability of the various inserts, such as the modular insert 13 and the insert 17, as well as the easy exchangeability of the oil orifice 12, the arrangement according to the present invention may be used on rotating machines of many types and size without requiring special structural measures. As will be apparent from the drawings, the outer contours of the inserts 13 and 17 are configured to define identical mounting surfaces arranged to coincide with the mating contours of mounting surfaces defined on the internal oil connection housing 5 with which they may be interchangeably engaged thereby facilitating the interchangeable removal and replacement of the inserts 13 and 17.

Because of the arrangement described above of the internal oil connector housing 5 with the removable inserts 13 and 17, the lines which are required to carry fluid pressure need not be placed along the outside of the bearing block and as a result fire hazards which might occur because of leakage danger may be eliminated.

While specific embodiments of the invention have been shown and described in detail to illustrate the application of the inventive principles, it will be understood that the invention may be embodied otherwise without departing from such principles.

What is claimed is:

1. An internal oil connector assembly for the bearing block of a rotating machine having combined lubricating and oil scavenging means comprising: a connector housing; a modular insert including connections for oil inlet measuring means, oil outlet means and removable interchangeable oil orifice means; a scavenging insert including means for scavenging the oil lines of said assembly; mounting surfaces defined on said connector housing; mounting surfaces defined on both said modular insert and said scavenging insert each configured for mating engagement with said mounting surfaces defined on said connector housing for enabling said modular insert and said scavenging insert, respectively, to be operatively connected in said connector housing; said mounting surfaces on said modular insert and said mounting surfaces on said scavenging insert being identically configured to enable said inserts to be exchangeably mounted in said connector housing with each of said inserts being adapted to be removed from said housing and replaced by the other of said inserts.

2. An assembly according to claim 1 wherein said bearing block includes an oil discharge line and wherein said scavenging insert includes a short circuit oil line extending to said oil discharge line arranged in said housing for scavenging the oil lines of said assembly.

3. An assembly according to claim 1 wherein said scavenging insert includes connection means for scavenging lines connected to said short circuiting oil line for scavenging the inner surface of said bearing block.

4. An assembly according to claim 3 wherein said hearing block includes an oil supply pressure line and wherein said scavenging insert includes a connection for said scavenging lines which opens into said oil supply pressure line.

5. An assembly according to claim 1 including plug means provided in said short circuit oil line for enabling testing of the oil lines of said assembly.

6. An assembly according to claim 5 including filter means arranged on said short circuit oil line for enabling scavenging of the oil lines of said assembly.

* * * * *